US009333408B1

(12) United States Patent
Hedrick

(10) Patent No.: US 9,333,408 B1
(45) Date of Patent: May 10, 2016

(54) GOLF SWING AID

(71) Applicant: David B. Hedrick, Clinton, IL (US)

(72) Inventor: David B. Hedrick, Clinton, IL (US)

( * ) Notice: Subject to any disclaimer, the term of this patent is extended or adjusted under 35 U.S.C. 154(b) by 0 days.

(21) Appl. No.: 14/331,275

(22) Filed: Jul. 15, 2014

Related U.S. Application Data

(60) Provisional application No. 61/862,642, filed on Aug. 6, 2013.

(51) Int. Cl.
*A63B 69/36* (2006.01)

(52) U.S. Cl.
CPC ..... *A63B 69/3632* (2013.01); *A63B 2243/0029* (2013.01)

(58) Field of Classification Search
CPC ..... A63B 69/3632; A63B 69/3685; A63B 69/3638; A63B 69/3608; A63B 69/3641
USPC ..... 473/219, 226, 227, 231, 238
See application file for complete search history.

(56) References Cited

U.S. PATENT DOCUMENTS 760,161 A * 5/1904 Smith ..... 473/294
3,298,693 A * 1/1967 Eisenberg ..... A63B 69/3632 473/238
3,758,117 A * 9/1973 Harrison ..... 473/231
4,023,812 A * 5/1977 Lorang ..... 473/227
4,145,054 A * 3/1979 Stewart ..... 473/227
4,170,356 A * 10/1979 Banks ..... 473/227
4,682,775 A * 7/1987 Wood ..... A63B 69/3632 473/227
4,789,158 A * 12/1988 Chiesa ..... A63B 69/3632 473/238
4,944,516 A * 7/1990 Bickler ..... A63B 69/3685 473/227
4,949,971 A * 8/1990 Thornton ..... A63B 69/3685 473/238
5,009,426 A * 4/1991 Cox ..... 473/227
5,143,376 A * 9/1992 Johnson ..... A63B 69/3632 473/218
5,441,270 A * 8/1995 Williams ..... 473/251
5,441,273 A * 8/1995 Stormon ..... 473/251
5,524,892 A 6/1996 Karp
5,605,509 A * 2/1997 Gray ..... A63B 69/3632 473/237
5,716,286 A * 2/1998 Swan ..... A63B 21/153 273/DIG. 21
5,762,564 A * 6/1998 Schang ..... A63B 69/3685 473/238
6,251,025 B1 * 6/2001 Brock et al. ..... 473/227
6,491,591 B1 * 12/2002 Schuster ..... 473/212
6,656,056 B1 * 12/2003 Leonard ..... 473/227
6,857,970 B2 * 2/2005 Robbins ..... A63B 69/3608 473/201
7,059,970 B1 * 6/2006 Hamburger ..... A63B 69/3685 473/219
7,258,622 B1 8/2007 Gaviria
7,427,238 B1 * 9/2008 Oprandi ..... A63B 69/3632 473/221
7,727,080 B1 * 6/2010 Fitzgerald ..... A63B 69/3632 473/221
7,780,542 B1 8/2010 Ross et al.
8,388,460 B1 * 3/2013 Schantz ..... 473/223
D709,977 S * 7/2014 Mills ..... D21/791
2005/0107180 A1 * 5/2005 Halleck ..... A63B 69/3632 473/220
2006/0122000 A1 * 6/2006 Paredes et al. ..... 473/219

* cited by examiner

*Primary Examiner* — Sebastiano Passaniti
(74) *Attorney, Agent, or Firm* — Philip L. Bateman

(57) ABSTRACT

A golf swing aid is attached to the shaft of a golf club. The aid comprises (a) a sleeve having a longitudinal slot defining a longitudinal axis for frictional attachment to a shaft of a golf club; and (b) a rod extending outwardly from the sleeve opposite the longitudinal slot and forming an angle of about 40 to 80 degrees to the longitudinal axis of the sleeve. When the club is swung optimally, the rod is hidden beneath the shaft when the ball is contacted.

6 Claims, 4 Drawing Sheets

GOLF SWING AID

CROSS-REFERENCE TO RELATED APPLICATION

This application claims the benefit of U.S. Provisional Application Ser. No. 61/862,642, Aug. 6, 2013.

FIELD OF THE INVENTION

This invention relates to games using a tangible projectile. More particularly, this invention relates to a golf swing aid.

BACKGROUND OF THE INVENTION

Golf is a game that originated in Scotland and is now popular around the World. The game is played by hitting a hard ball into successive holes in as few strokes as possible with clubs consisting of a head, a shaft, and a grip. When the ball is relatively close to the hole, it is hit with a special golf club known as a putter having a head with a nearly-vertical face (hitting surface) to roll it along the ground. When the ball is further away from the hole, the ball is hit with one of several golf clubs having heads with angled-back faces that propel the ball into the air. Such golf clubs include woods (originally made of blocks of wood and now made of hollow metal bodies) and irons (relatively flat steel blades).

For many golf shots, the goal is to hit the ball accurately (so it goes in the direction and with the desired trajectory) with maximum velocity. Maximum accuracy is achieved by positioning the face of the golf club perpendicular to the target line at address and at impact (commonly known as squaring the club face). Maximum velocity is achieved by having all parts of the body functioning optimally to generate maximum club head speed at impact with the face of the club making contact with the ball at the optimal location (commonly known as the sweet spot of the club). Maximum club head speed requires a full rotation of the upper body, a weight transfer from the back leg to the front leg, and a movement of the wrists and hands that is known as a hinging and unhinging (also known as a cocking and uncocking) of the wrists. As the wrists unhinge at impact, the lower hand passes over (changes from following to leading) the upper hand. Accomplished golfers can swing a golf club to generate a club head speed of well over 100 miles per hour at impact which can send the ball over 300 yards in the air.

Hitting a ball accurately and at high velocity requires considerable skill. Both professional and amateur golfers spend many hours practicing their swings and are constantly trying to improve them. A wide variety of golf swing aids have been disclosed to help golfers improve their swings.

One class of golf swing aids are indicator devices that are temporarily attached to the shaft. The indicators project from the shaft outwardly over the ball (on the opposite side of the golfer). The indicators help the golfer square the face of the golf club at address and at contact. Such golf swing aids are disclosed in Chiesa, U.S. Pat. No. 4,789,158, Dec. 6, 1988; Johnson, U.S. Pat. No. 5,143,376, Sep. 1, 1992; Karp, U.S. Pat. No. 5,524,892, Jun. 11, 1996; and Ross et al., U.S. Pat. No. 7,780,542, Aug. 24, 2010. Gaviria, U.S. Pat. No. 7,258,622, Aug. 21, 2007, discloses an indicator having one leg/arm that projects outwardly, perpendicularly to the shaft, over the ball. The indicator optionally contains additional legs/arms that project toward the target, away from the target, and toward the golfer. While these indicator devices are helpful in learning to square the face of the golf club, they are of limited value in learning the optimal unhinging of the wrists.

Accordingly, there is a demand for an improved golf swing aid. More particularly, there is a demand for a golf swing aid that enables a golfer to learn the optimal unhinging of the wrists to generate maximum club head speed.

SUMMARY OF THE INVENTION

The general object of this invention is to provide an improved golf swing aid. A more particular object is to provide a golf swing aid that enables a golfer to learn the optimal unhinging of the wrists to generate maximum club head speed.

I have invented a golf swing aid comprising: (a) a sleeve having a longitudinal slot defining a longitudinal axis for frictional attachment to a shaft of a golf club; and (b) a rod extending outwardly from the sleeve opposite the longitudinal slot and forming an angle of about 40 to 80 degrees to the longitudinal axis of the sleeve.

I have also invented a training golf club comprising: (a) a golf club having a head, a shaft, and a grip; and (b) a golf swing aid attached to the shaft adjacent the head, the aid comprising: (i) a sleeve having a longitudinal slot defining a longitudinal axis that is frictionally attached to the shaft of the golf club with the longitudinal slot directly above the head of the golf club; and (ii) a rod extending outwardly from the sleeve opposite the longitudinal slot and forming an angle of about 40 to 80 degrees to the longitudinal axis of the sleeve.

I have also invented a method of training a golfer to make an optimal golf swing. The method comprises: (a) obtaining a golf club having a head, a shaft, and a grip; (b) obtaining a golf swing aid comprising: (i) a sleeve having a longitudinal slot defining a longitudinal axis for frictional attachment to the shaft of the golf club; and (ii) a rod extending outwardly from the sleeve opposite the longitudinal slot and forming an angle of about 40 to 80 degrees to the longitudinal axis of the sleeve; (c) attaching the golf swing aid on the shaft of the golf club adjacent the head, with the longitudinal slot directly over the head of the golf club, and with the rod being substantially horizontal when the golf club is held in an address position; and (d) swinging the golf club at a ball while attempting to orient the club so that the rod is hidden beneath the shaft when the ball is contacted.

The golf swing aid of this invention is effective at helping a golfer learn to optimize his golf swing. In particular, the aid enables a golfer to learn the optimal unhinging of the wrists to generate maximum club head speed at impact. The aid is easy to use, compact, and light in weight.

DETAILED DESCRIPTION OF THE INVENTION

Figure 2:
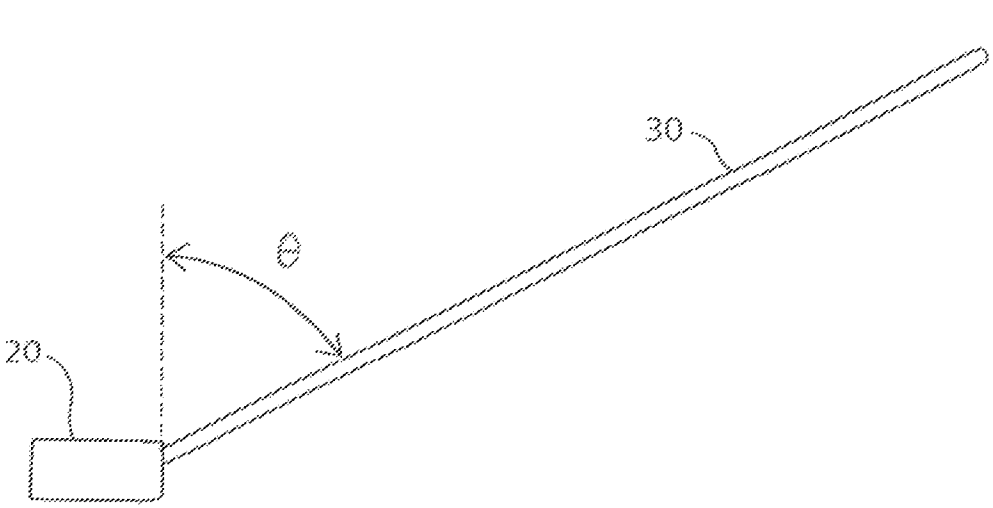
FIG. 2 is a side elevation view thereof.
Figure 1:
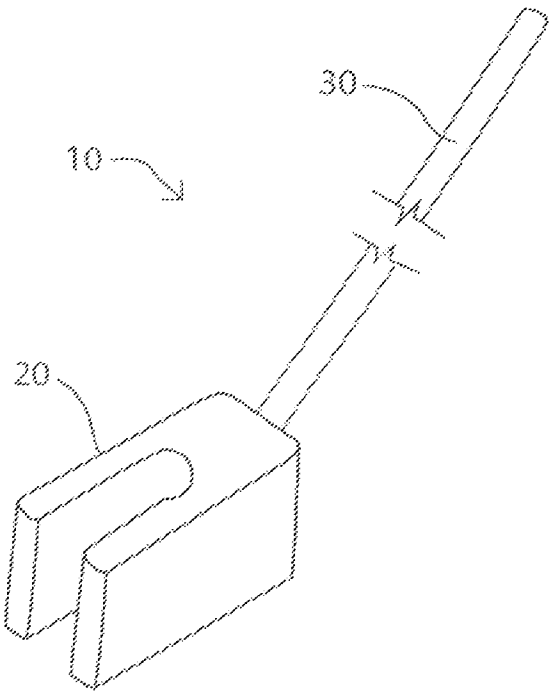
FIG. 1 is a perspective view of an embodiment of the golf swing aid of this invention.
Figure 4:
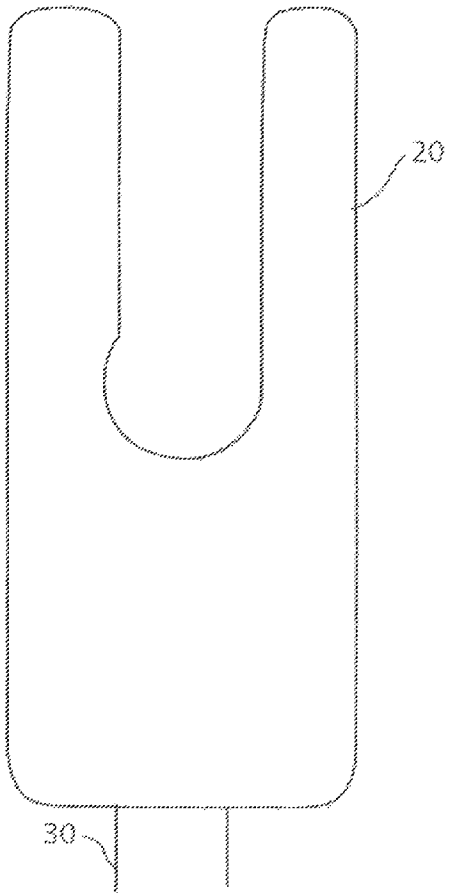
FIG. 4 is a top plan view of the sleeve of the golf swing aid.

This invention is best understood by reference to the drawings. Referring first to FIGS. 1, 2, and 4, a first embodiment of the golf swing aid 10 of this invention comprises a sleeve 20 and an outwardly extending rod 30. The aid is used by temporarily attaching it to a golf club at the bottom of the shaft where the shaft meets the head. A golfer then makes swings with the golf club and observes the position of the aid relative to the shaft of the golf club.

The sleeve 20 provides the means for attaching the aid to a shaft of a golf club. The sleeve has a slot on the side opposite the rod. The slot extends between the top and bottom of the sleeve. The furthest inward portion of the slot forms a curved channel into which a shaft of a golf club fits tightly. The channel defines a longitudinal axis. The sleeve preferably fits as tightly onto the shaft as possible while still being easily attached and removed. The curved channel portion of the slot is sized to provide the desired tight, frictional fit on a shaft. The diameter of the curved portion of the slot is generally about one-fourth to one-half inches, preferably about three-eighths inches, in accordance with typical shaft diameters at the point near to where the head is attached. The curved portion makes contact with (i.e., extends around an arc of) at least 180 degrees of the shaft and preferably slightly more to further wrap around the shaft to increase the area of contact between the shaft and the sleeve. As best seen in FIG. 4, the slot of the first embodiment is slightly asymmetric so that the sides of the slot are slightly different in thickness.

In the first embodiment, the sleeve has the general exterior shape of a rectangular block with a length of about one to one and one-half inches, a width of about one-half to one inch, and a height of about one-half to one inch. The additional mass provides strength and rigidity to the sleeve. It also provides an enlarged base for connection of the extending rod.

The rod 30 extends outwardly from the sleeve opposite the slot. It can be seen that the aid is exactly or nearly equally balanced about a vertical plane passing through the rod. The balancing helps to resist twisting or other movement when the golf club is swung. The rod has a diameter of about one-eighth to three-eighths inch, preferably about one-fourth inch. As the rod diameter decreases, its durability decreases. As the rod diameter increases, its weight increases. The rod generally has a length (measured from the sleeve outward) of about six to sixteen inches, preferably about ten to fifteen inches, and most preferably about twelve to fourteen inches. As the length decreases, visibility from under the shaft decreases. As the length increases, its weight increases. If desired, a cap is placed on the distal end of the rod to provide an aesthetically pleasing appearance and to provide a rounded end without sharp edges.

Figure 3:
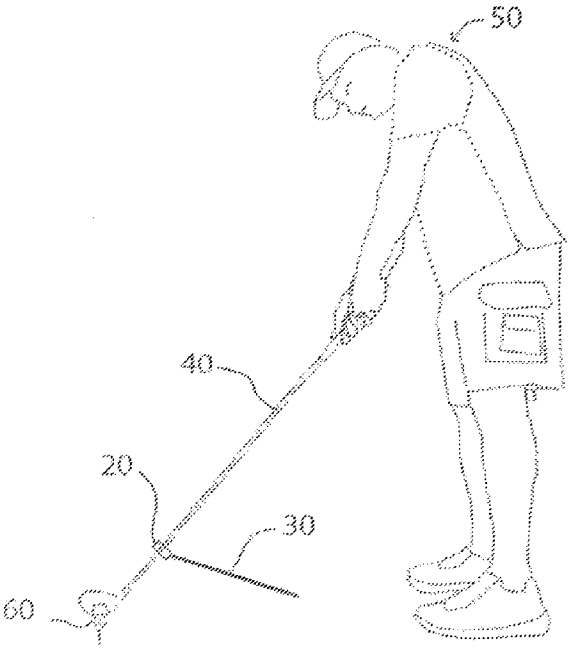
FIG. 3 is a front elevation view of a golfer holding a golf club with the golf swing aid attached thereto.

The rod makes an angle θ of about 40 to 80 degrees, preferably about 50 to 70 degrees, and most preferably about 60 degrees, to the longitudinal axis of the slot of the sleeve. As best seen in FIG. 3, this angle puts the rod in a substantially horizontal position (parallel to the ground) when attached to a golf club held at address. In this position, the rod does not hit the ground when the golf club is swung. It can be appreciated that golf clubs vary in length and therefore form a different angle to the ground. The angle made by the rod to the sleeve is preferably chosen so the rod is parallel when attached to a club having a medium length (such as a seven iron). It follows that the rod points slightly downward when used on a longer club (as seen in FIG. 3 in use with a driver) and would point slightly upward when used on a shorter club.

In the embodiment shown, the rod is a separate piece that is inserted into a receptacle in the sleeve. If desired, the rod is integral with the sleeve. In other words, the aid is molded as a single piece.

The golf swing aid is formed of a durable, waterproof, lightweight material. The material preferably has some resilience so the sleeve can deform slightly when placed onto or remove from the shaft. Preferred materials include thermoplastics such as nylon polyamide, acrylonitrile butadiene styrene (ABS), polyethylene, polypropylene, and polyvinylchloride (PVC), and other such materials including fiberglass, graphite, and the like. If the rod is separate from the sleeve, the rod and sleeve are made of different materials if desired. For example, a preferred two-part aid includes a rod made of fiberglass and a sleeve made of nylon polyamide. The aid is colored as desired. Light colors provide better visibility against the green surfaces common on golf courses. Bright colors such as orange or yellow are preferred for maximum visibility.

A second embodiment of the sleeve 120 of the golf swing aid is shown in FIGS. 6 to 9. The second embodiment of the sleeve differs from the first embodiment in several respects. Its slot is symmetrical so that both sides are of equal thickness. The curved channel portion of the slot contains a plurality of longitudinal ribs that help to grip the shaft of the golf club. Material around the rod receiving receptacle is omitted to save weight and cost. It also gives the sleeve an appearance that is more attractive to some.

Figure 5:
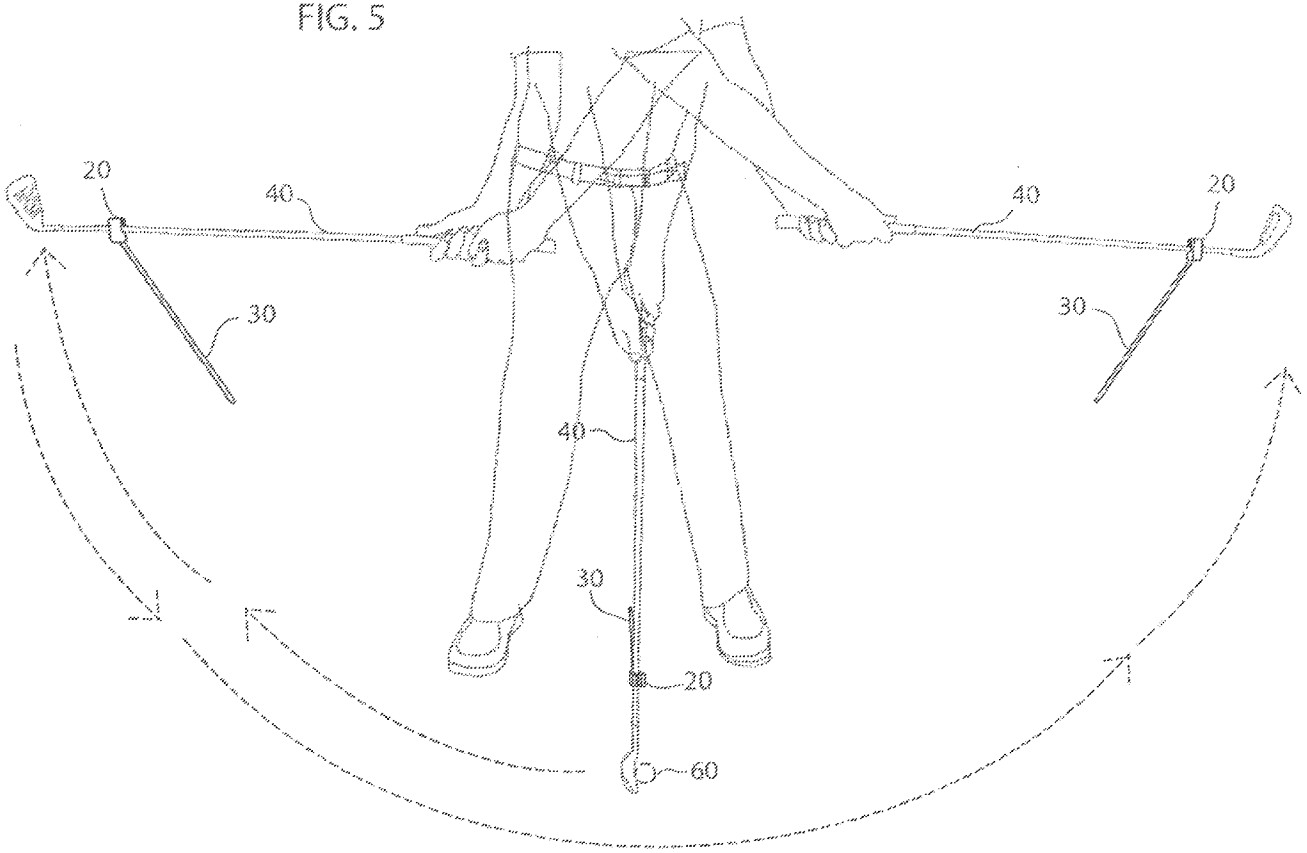
FIG. 5 is a front elevation view of a golfer swinging a golf club with the swing aid attached thereto.
Figure 7:
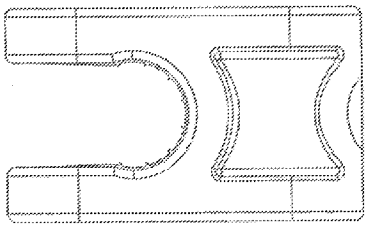
FIG. 7 is a top plan view thereof.
Figure 9:
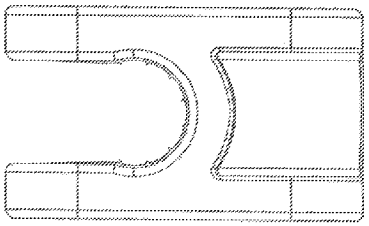
FIG. 9 is a bottom plan view thereof.
Figure 6:
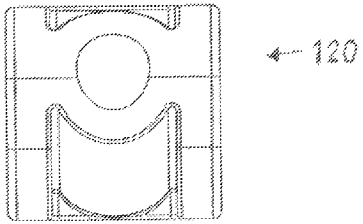
FIG. 6 is an elevation view of the rod receiving side of an alternate sleeve of the golf swing aid.
Figure 8:
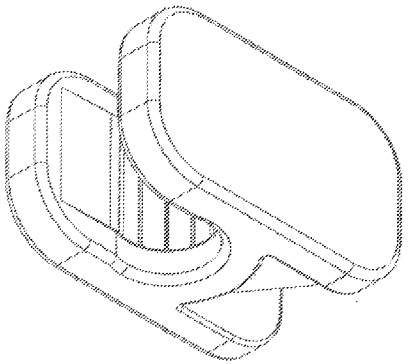
FIG. 8 is a bottom and side perspective view thereof.

The use of the golf swing aid can now be considered. Referring again to FIG. 3, the aid is pressed onto the shaft of a golf club 40 near to the point where the shaft meets the head. The heads of some golf clubs include a hosel and/or a ferrule. The aid is preferably used with clubs having a steel shaft. The tight fit may possibly cause damage graphite shafts if care is not taken. The aid is oriented so the rod is pointed at the golfer 50 at address. In this position the rod is hidden from the view of the golfer by the shaft. The golfer then swings the club, either with or without a ball 60. Referring now to FIG. 5, the use of the aid is illustrated in a sequence from a point of view facing the golfer. When the golfer makes a swing with the optimal unhinging of his wrists, he will see the rod extending from the leading side of the shaft as the club approaches the ball (or the point where a ball would be positioned). He will then see the rod disappear from view beneath the shaft at the impact position. He will then see the rod extending from the trailing side of the shaft as the club follows through.

The golf swing aid is effective at helping a golfer learn to optimize his golf swing by correctly unhinging his wrists at impact. The aid is easy to use. It is also compact and light in weight so it can be easily carried by a golfer is his golf bag and thereby always being readily available for practice.

I claim:

1. A training golf club comprising:

(a) a golf club having a shaft with a proximate upper end and a distal lower end, a head attached to the distal lower end of the shaft, and a grip covering the upper proximate end of the shaft, the golf club adapted to be held by a golfer at address; and (b) a golf swing aid attached to the distal lower end of the shaft adjacent the attachment of the head to the shaft, the aid comprising: (i) a sleeve having a top, a bottom, and a longitudinal slot forming an opening extending between the top and the bottom and defining a longitudinal axis that is frictionally attached to the shaft of the golf club with the longitudinal slot aligned directly above the head of the golf club, the sleeve having a generally block exterior shape with a length of about one to one and one-half inches; and (ii) a rod extending outwardly from the sleeve opposite the longitudinal opening and forming a nonadjustable angle of about 40 to 80 degrees relative to the longitudinal axis of the sleeve, with the nonadjustable angle being located between the rod and the proximate upper end of the shaft, such that the rod extends toward the golfer and is generally parallel to the ground when the golf club is held by the golfer at address, the golf swing aid being substantially equally balanced about a vertical plane passing through the rod, and the rod having a length of about six to sixteen inches and a diameter of about one-eighth to three-eighths inch.

2. The training golf club of claim 1 wherein the rod of the golf swing aid forms an angle of about 50 to 70 degrees to the longitudinal axis of the sleeve.

3. The training golf club of claim 1 wherein the slot of the sleeve of the golf swing aid forms a curved channel extending through an arc of greater than 180 degrees.

4. The training golf club of claim 1 wherein the rod of the golf swing aid has a length of about ten to fifteen inches.

5. The training golf club of claim 1 wherein the slot is asymmetric.

6. A training golf club comprising:

(a) a golf club having a shaft with a proximate upper end and a distal lower end, a head attached to the distal lower end of the shaft, and a grip covering the upper proximate end of the shaft, the golf club adapted to be held by a golfer at address; and (b) a golf swing aid attached to the distal lower end of the shaft adjacent the attachment of the head to the shaft, the aid comprising: (i) a sleeve having a top, a bottom, and a longitudinal slot forming an opening extending between the top and the bottom and defining a longitudinal axis that is frictionally attached to the shaft of the golf club with the longitudinal slot aligned directly above the head of the golf club; and (ii) a rod having a length of about six to sixteen inches and a diameter of about one-eighth to three-eighths inch extending outwardly from the sleeve opposite the longitudinal opening and forming a nonadjustable angle of about 40 to 80 degrees relative to the longitudinal axis of the sleeve, with the nonadjustable angle being located between the rod and the proximate upper end of the shaft, such that the rod extends toward the golfer and is generally parallel to the ground when the golf club is held by the golfer at address.

* * * * *